US006280255B1

(12) United States Patent
Wu et al.

(10) Patent No.: US 6,280,255 B1
(45) Date of Patent: Aug. 28, 2001

(54) BATTERY CONNECTOR HAVING RELIABLY POSITIONED TERMINALS

(75) Inventors: Jerry Wu; Kelly Shih, both of Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/516,471

(22) Filed: Mar. 1, 2000

(30) Foreign Application Priority Data

Dec. 23, 1999 (TW) ..... 88221948

(51) Int. Cl.[7] ..... H01R 12/20
(52) U.S. Cl. ..... 439/660; 439/79
(58) Field of Search ..... 439/79, 660, 83, 439/733.1

(56) References Cited

U.S. PATENT DOCUMENTS 5,551,883 * 9/1996 Davis ..... 439/65
6,050,858 * 4/2000 Liu et al. ..... 439/660

* cited by examiner

*Primary Examiner*—Gary F. Paumen
(74) *Attorney, Agent, or Firm*—Wei Te Chung

(57) ABSTRACT

A battery connector according to the present invention comprises an insulative housing and a plurality of terminals received in the insulative housing. The insulative housing includes a plurality of partitions in a middle portion of the housing. The partitions define a plurality of cavity sections therebetween for receiving mating contacts of a mating connector. A groove and a recess are respectively defined in an upper portion of each partition and in a rear top wall between adjacent partition. Each terminal includes a retaining body, a soldering leg downwardly extending at a rearward side of the retaining body, a contacting arm for electrically connecting with a complementary connector angularly extending from a lower front edge of the retaining body into a corresponding cavity section and a fixing tail rearwardly extending from a rear edge of the retaining body of the terminal for being held in a recess of the insulative housing. A clamping end depends perpendicularly from the fixing tail for being retained in the groove of a partition.

1 Claim, 5 Drawing Sheets

BATTERY CONNECTOR HAVING RELIABLY POSITIONED TERMINALS

BACKGROUND OF THE INVENTION

The present invention relates to an electrical connector having a structure for firmly retaining a plurality of terminals, particularly to a battery connector for firmly and accurately positioning the terminals in the battery connector.

Since the trend in notebook computers is toward lighter weight and a smaller profile, battery connectors having a low profile above a printed circuit board (PCB) in notebooks are usually desired to allow the profile of the battery package used in the notebook to meet the space requirements of the notebook. A conventional battery connector is mounted on top of a printed circuit board, resulting in a conventional battery package profile which includes at least the height of the connector and the thickness of the PCB. Such a battery connector and related battery package are illustrated in U.S. Pat. No. 5,551,883. With reference to FIGS. 1, 8–10 and 12 of that patent, a battery connector 1 comprises an insulative housing 2, at least a cavity 3 defined in the housing 2 and an electrical contact 4 received in each cavity 3. Each cavity 3 comprises a first cavity portion 5 receiving the contact 4 and a second cavity portion 6 receiving a mating contact 7 of a mating connector 8. A first channel 24 has a stepped width defining a groove 26 and a shoulder 27. The contact 4 includes a thin blade 11 and a contact portion 15 forwardly and diagonally extending from a front edge of the blade 11. The contact portion 15 has a tip 17 which remains within the first channel 24 behind the shoulder 27. The housing 2 provides a pair of projecting posts 21 on a bottom thereof to be connected to a printed circuit board (not shown).

The connector is entirely mounted on the printed circuit board, thus, the profile of the connector above the printed circuit board is the whole height of the connector itself. Furthermore, the connector lacks a fixing means to effectively prevent an impact force from acting on the contacts 13 when a battery is inserted into the notebook and connected with the mating connector 8, so that over time, the electrical connection between the contacts 4 and the printed circuit board may mechanically break.

Therefore, an improved battery connector is necessary to overcome the disadvantages of the prior art.

BRIEF SUMMARY OF THE INVENTION

A main object of the present invention is to provide a battery connector having a plurality of terminals which can be firmly retained in an insulative housing of the battery connector.

Another object of the present invention is to provide a battery connector having a reduced profile above a PCB when the battery connector is mounted on the PCB.

An electrical connector according to the present invention comprises an insulative housing and a plurality of terminals received in the insulative housing. The insulative housing includes a plurality of partitions in a middle portion of the housing. The partitions are uniformly spaced apart from each other to define a plurality of cavity sections for receiving mating contacts of a mating battery connector. A groove and a recess are respectively defined in an upper portion of each partition and in a rear top wall adjacent each partition. The insulative housing has a mounting portion for mounting the battery connector on an upper face of a printed circuit board, thereby producing a lower profile above the printed circuit board.

Each terminal comprises a retaining body at a rear side thereof. A soldering leg downwardly extends at a rearward side of the retaining body. A contacting arm for electrically connecting with a complementary connector angularly extends from a lower front edge of the retaining body into a corresponding cavity section and a fixing tail rearwardly depends from an upper rear edge of the retaining body for being retained in a recess of the insulative housing. A clamping end extends from a lower edge of the fixing tail for being accommodated in a groove of the insulative housing. The clamping end and the fixing tail are generally perpendicular to each other for fixing the terminal in the housing.

Other objects, advantages and novel features of the invention will become more apparent from the following detailed description when taken in conjunction with the accompanying drawings.

DETAILED DESCRIPTION OF THE INVENTION

Figure 1:
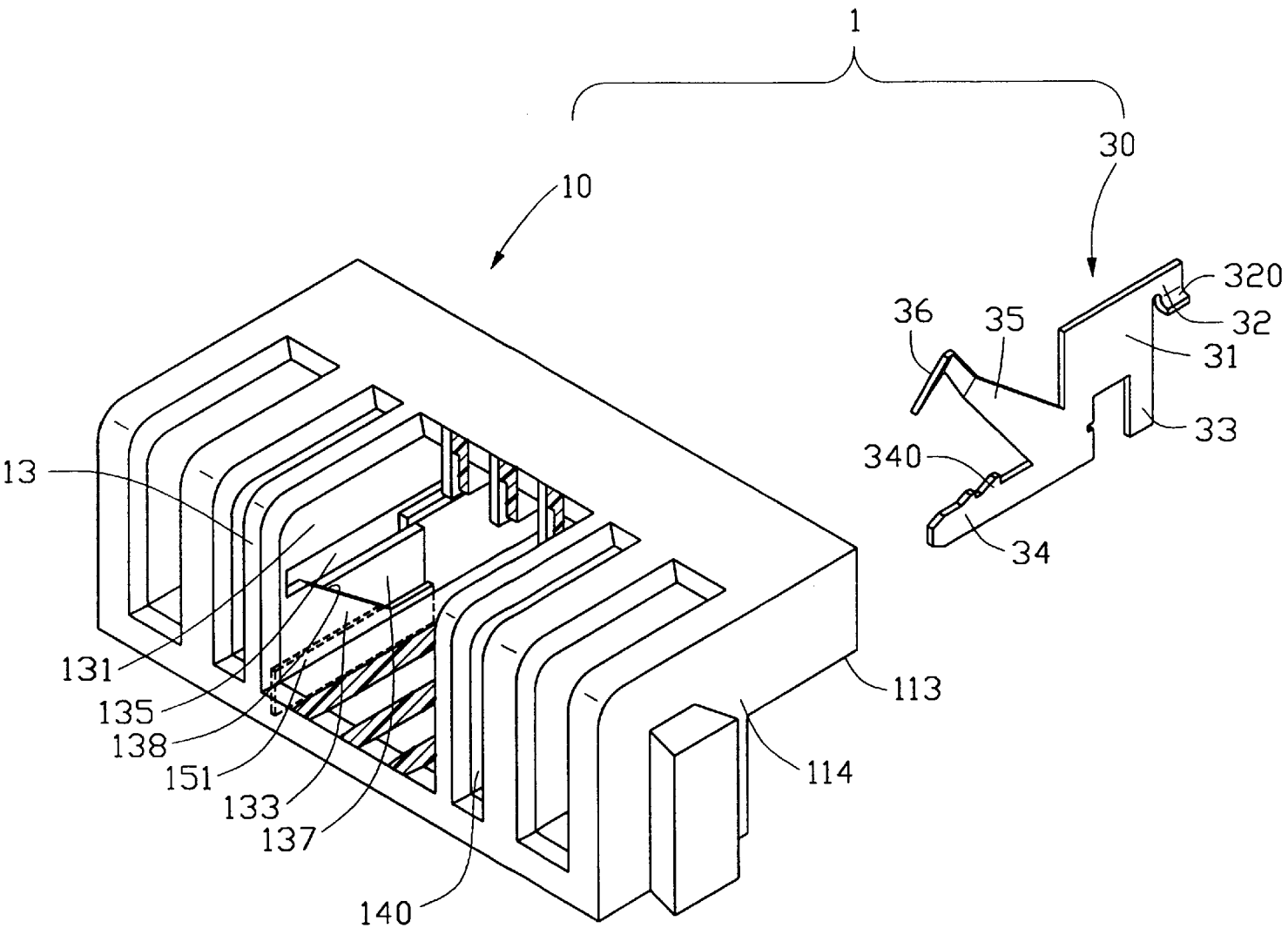
FIG. 1 is a perspective view of a battery connector of the present invention, wherein an insulative housing and one terminal are shown and a portion of the housing is cut away to show an inner structure thereof.
Figure 2:
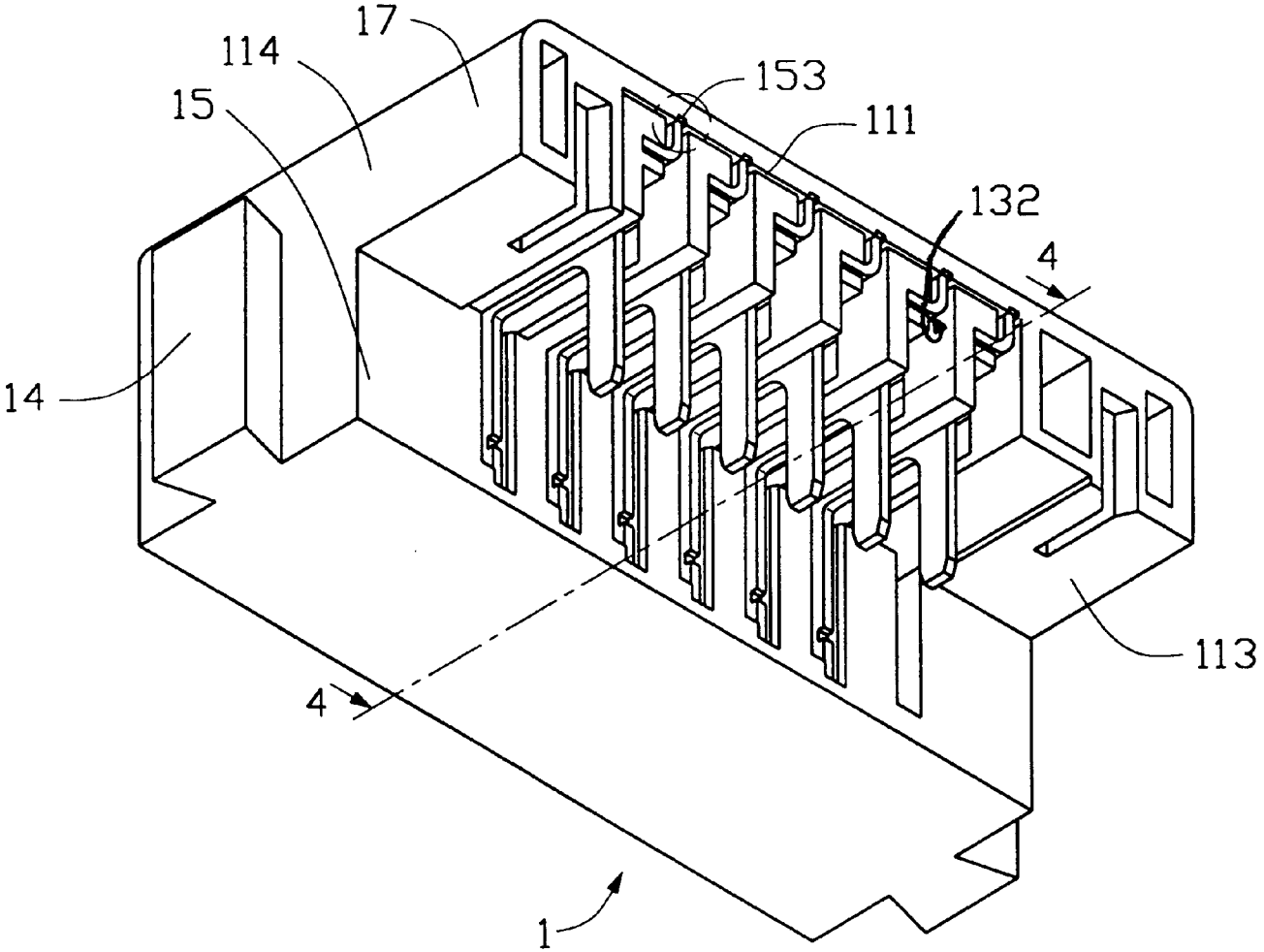
FIG. 2 is an assembled view of the battery connector of the present invention as viewed from a rear side of the battery connector.

Referring to FIGS. 1 and 2, a battery connector 1 in accordance with the present invention comprises an insulative housing 10 and a plurality of terminals 30 (only one shown in FIG. 1) received in the insulative housing 10. The insulative housing 10 is unitarily formed and includes a plurality of partitions 13 in a middle portion of the housing and a rear top wall 111. The partitions 13 are spaced equidistantly apart from each other in a lengthwise direction of the housing 10 to define a plurality of cavity sections 140 therebetween for receiving mating contacts of a mating battery connector (not shown) therein.

Each partition 13 includes a separating wall 137 and a terminal receiving wall 133 beside the separating wall 137. The terminal receiving wall 133 forms an inclined upper face 138 and defines a terminal passageway 151 in a lower portion thereof.

Each partition 13 further forms an upper portion 131 extending to the rear top wall 111. The rear top wall 111 defines a recess 153 adjacent to a rear edge thereof and adjacent to each partition 13. A groove 132 is defined in one side of the upper portion 131 of the partition 13 and is substantially perpendicular to the recess 153. A slit 135 is intermediately and transversely defined between the upper portion 131 and the separating wall 137.

A pair of projecting tabs 14 are respectively disposed at opposite side surfaces 114 of the insulative housing 10 and each projecting tab 14 outwardly extends with a gradually enlarged cross-sectional width for providing a reliable engagement with the mating battery connector.

Referring to FIG. 1, each terminal 30 of the battery connector 1 includes a roughly rectangular retaining body 31 at a rear side thereof with a retaining arm 34 forwardly extending from a forward lower edge of the retaining body 31. A plurality of retaining barbs 340 are provided on an upper edge of the retaining arm 34 of the terminal 30 for facilitating the reliable fixation of the retaining arm 34 in the insulative housing 10. A contacting arm 35 extends in a diagonally forward and upward direction from a forward and lower corner of the retaining body 31 of the terminal 30. The contacting arm 35 of the terminal 30 has a contacting portion 36 at a distal end thereof, the contacting portion 36 laterally bending for electrically connecting with a mating contact of a mating battery connector. A soldering leg 33 downwardly extends at a rearward side of the retaining body 31 of the terminal 30. A fixing tail 32 rearwardly depends from an upper rear edge of the retaining body 31 of the terminal 30 adjacent to the soldering leg 33. A clamping end 320 downwardly extends from a lower edge of the fixing tail 32 and bends generally perpendicular to the fixing tail 32.

Figure 3:
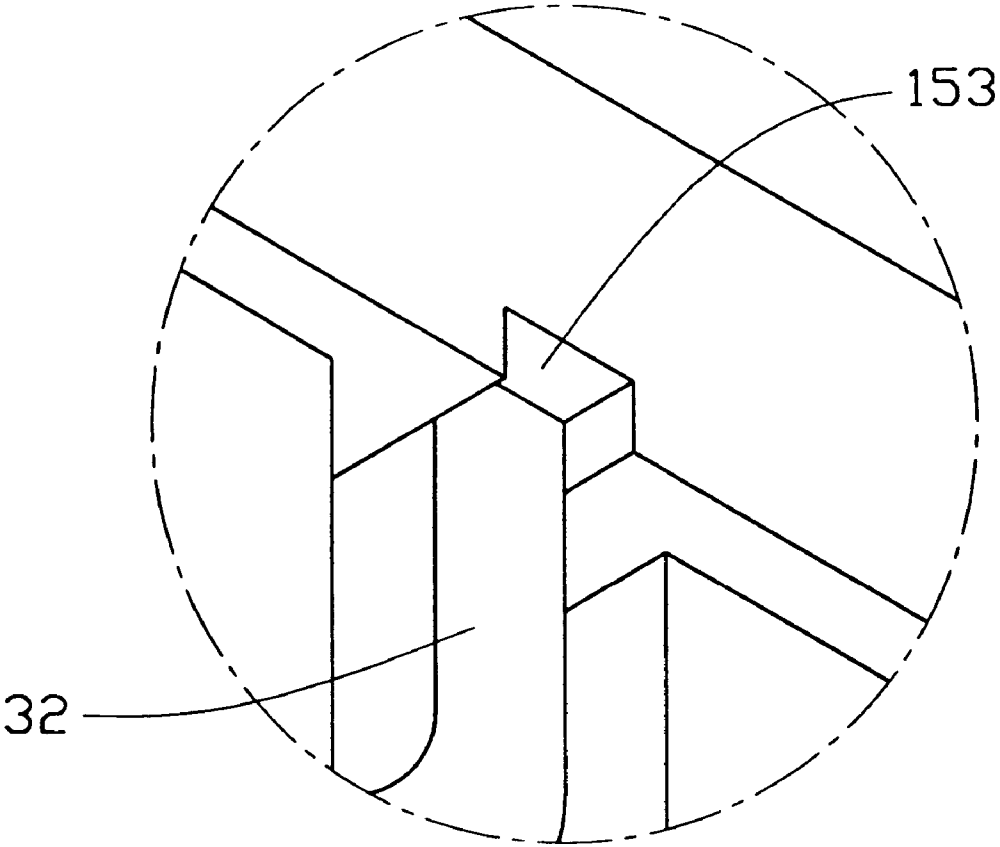
FIG. 3 is a partial enlarged view of FIG. 2, detailing a portion of FIG. 2 indicated by a circle.
Figure 4:
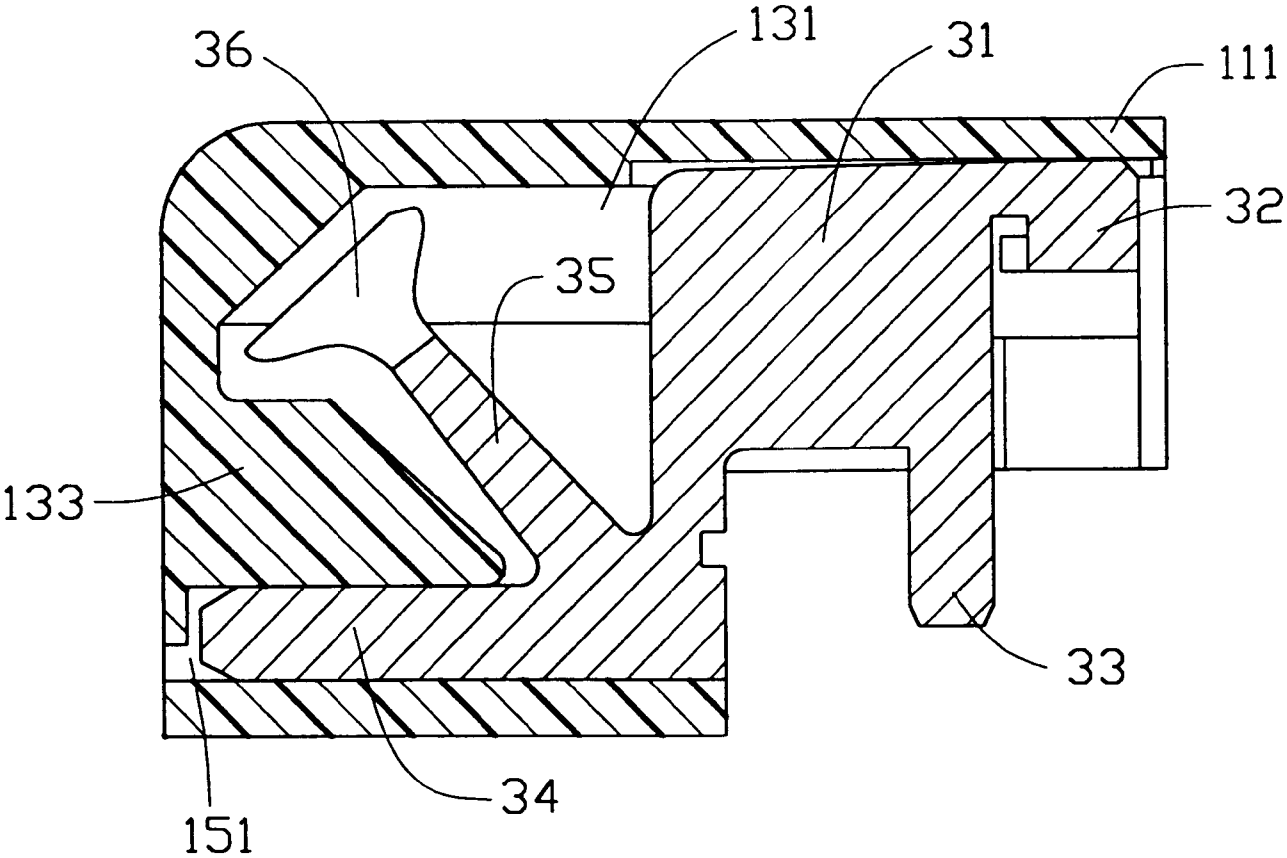
FIG. 4 is a cross-sectional view taken along line 4—4 in FIG. 2.
Figure 5:
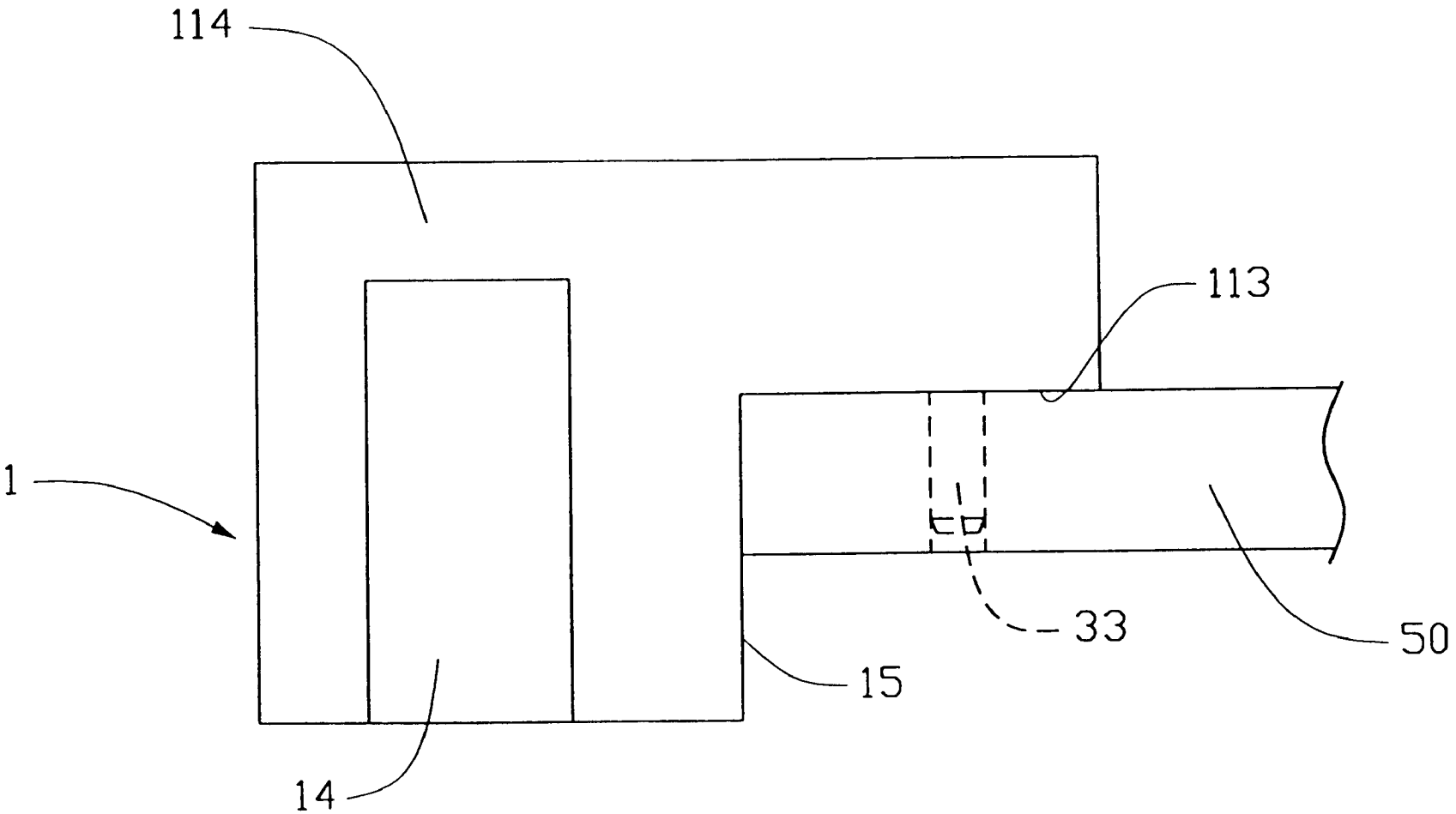
FIG. 5 is a side view of FIG. 1 with the electrical connector mounted on a PCB.

During assembly, referring to FIGS. 2, 3 and 4, the retaining arm 34 of a terminal 30 is first inserted into a terminal passageway 151 of the insulative housing 10. The contacting arm 35 of the terminal 30 is received adjacent to a side of the corresponding separating wall 137, and a lower edge of the contacting arm 35 abuts against the corresponding upper inclined face 138. The contacting portion 36 of the contacting arm 35 extends beyond the separating wall 137 and through the slit 135 of the corresponding partition 13 of the insulative housing 10, being accommodated in the corresponding cavity section 140 for electrically contacting a mating contact in the cavity section 140. The retaining body 31 of the terminal 30 is accommodated adjacent to the upper portion 131 of the neighboring partition 13 and firmly abuts against the corresponding upper portion 131 of the insulative housing 10 only when a mating contact is inserted into the cavity section 140 of the insulative housing 10. The soldering leg 33 of the terminal 30 extends downward from an upper part 17 (see FIG. 2) of the insulative housing 10 for soldering to a printed circuit board 50 (see FIG. 5). The fixing tail 32 of the terminal 30 is held in the corresponding recess 153 of the rear top wall 111. The clamping end 320 of the terminal 30 is retained in the groove 132 in the upper portion 131 of the neighboring partition 13. The fixation of the terminal 30 in the insulative housing 10 is thus obtained in directions which are perpendicular to each other due to the perpendicular relationship of the clamping end 320 and the fixing tail 32.

When the battery connector 1 is mounted to the printed circuit board 50, a contacting face 15 (see FIG. 2) at a rear side of the battery connector 1 abuts a side of the printed circuit board 50 and a mounting portion 113 of the battery connector 1 contacts an upper face of the printed circuit board 50. A mating battery connector (not shown) mates with the battery connector 1 from the top (not labeled) of the insulative housing 10. The projecting tabs 14 on the side surfaces 114 of the insulative housing 10 latch with a package (not shown) which connects to the printed circuit board 50 and the battery connector 1. Thus, only the upper part 17 is disposed above the printed circuit board 50, resulting in a low profile above the printed circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A battery connector comprising:

an insulative housing including a raised mounting portion for mounting the battery connector to a printed circuit board, a plurality of partitions located in a middle portion of the housing and rearwardly extending from a front face to a rear top wall thereof, a groove and a recess being respectively defined in an upper portion of each partition and in the rear top wall and adjacent each partition, the partitions defining a plurality of cavity sections therebetween opening to the front face and a top face of the connector for receiving mating contacts of a mating battery connector therein; and a plurality of terminals being received in the insulative housing, each terminal including a retaining body received in a corresponding recess, a soldering leg downwardly extending at a rearward lower side of the retaining body and beyond the mounting portion, and a fixing tail rearwardly depending from an upper rearward edge of the retaining body and being retained in a corresponding recess, a clamping end extending from an edge of the fixing tail and being accommodated in a corresponding groove, and a contacting arm for electrically connecting with a complementary connector angularly extending from a front edge of the retaining body into a corresponding cavity section;

wherein the clamping end and the fixing tail are generally perpendicular to each other, whereby the terminal is reliably fixed within the housing in a direction which is coplanar with and perpendicular to the retaining body thereof;

wherein each partition of the insulative housing has a separating wall and a terminal receiving wall adjacent to the separating wall;

wherein the terminal receiving wall defines a terminal passageway at a lower portion thereof, and a retaining arm forwardly extends from a forward lower edge of the retaining body for being retained in the terminal passageway;

wherein a plurality of retaining barbs are provided on an upper edge of the retaining arm for facilitating the reliable fixation of the retaining arm in the insulative housing;

wherein the contacting arm has a contacting portion at a distal end thereof, the contacting portion laterally bending for electrically connecting with a mating contact of a mating battery connector;

wherein a pair of projecting tabs are respectively disposed at opposite side surfaces of the insulative housing;

wherein each projecting tab outwardly extends with a gradually enlarged cross-sectional width for reliably retaining the battery connector in a package.

* * * * *